US008887347B2

(12) United States Patent
Louis et al.

(10) Patent No.: US 8,887,347 B2
(45) Date of Patent: Nov. 18, 2014

(54) CONVERSION MECHANISM FOR SWITCHING EXTRACTOR CLEANING MACHINE FROM FLOOR CLEANING TO HOSE CLEANING

(75) Inventors: Jeffrey S. Louis, Akron, OH (US); Patrick J. Quinn, North Canton, OH (US); Steven J. Paliobeis, Mentor, OH (US); Robert A. Salo, Mentor, OH (US); John Bantum, Munroe Falls, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 561 days.

(21) Appl. No.: 13/224,189

(22) Filed: Sep. 1, 2011

(65) Prior Publication Data

US 2012/0066861 A1 Mar. 22, 2012

Related U.S. Application Data

(60) Provisional application No. 61/379,181, filed on Sep. 1, 2010.

(51) Int. Cl.

| | |
|---|---|
| ***A47L 9/00*** | (2006.01) |
| ***A47L 11/34*** | (2006.01) |
| ***A47L 11/40*** | (2006.01) |

(52) U.S. Cl.

CPC ..... *A47L 11/34* (2013.01); *A47L 11/4016* (2013.01); *A47L 11/4094* (2013.01)

USPC ..... 15/320

(58) Field of Classification Search

CPC ..... A47L 9/2863

USPC ..... 15/320, 334, 338

See application file for complete search history.

(56) References Cited

U.S. PATENT DOCUMENTS

| | | | |
|---|---|---|---|
| 2,321,648 | A | 6/1943 | Brunner, Jr. |
| 2,867,833 | A | 1/1959 | Duff |
| 3,300,806 | A | 1/1967 | Ripple |
| 3,540,072 | A | 11/1970 | Wolter et al. |
| 3,715,775 | A | 2/1973 | Nickelson |

(Continued)

OTHER PUBLICATIONS

PCT/US2011/050251 International Search Report and Written Opinion dated Apr. 27, 2012 (11 pages).

(Continued)

*Primary Examiner* — Lee D Wilson
*Assistant Examiner* — Henry Hong
(74) *Attorney, Agent, or Firm* — Michael Best & Friedrich LLP

(57) ABSTRACT

An extractor-type surface cleaning machine includes a base or foot having a suction nozzle and a handle that is pivotally coupled to the foot and moveable between upright and inclined positions. The recovery tank is removably securable to the foot and fluidly communicates with the suction nozzle and the accessory. The recovery tank defines a collection chamber and a passage having an inlet in communication with the suction nozzle and an outlet. A valve member is moveable between a closed position substantially covering the outlet and an open position. Movement of the handle to the upright position moves the valve member to the closed position to block the passage during cleaning with the accessory hose. Movement of the handle to the inclined position allows movement of the valve member to the open position so that suction from the collection chamber is communicated to the suction nozzle for floor cleaning.

25 Claims, 9 Drawing Sheets

(56) References Cited

U.S. PATENT DOCUMENTS

| | | | | |
|---|---|---|---|---|
| 3,869,751 | A | 3/1975 | Boyd et al. | |
| 3,879,797 | A | 4/1975 | Principe et al. | |
| 3,942,216 | A | 3/1976 | Minton | |
| 4,225,999 | A | 10/1980 | Martinec et al. | |
| 4,761,850 | A | 8/1988 | Romeo et al. | |
| 4,809,397 | A | 3/1989 | Jacobs et al. | |
| 4,955,106 | A | 9/1990 | Stein et al. | |
| 4,987,637 | A | 1/1991 | Zummer et al. | |
| 5,233,722 | A | 8/1993 | McKnight et al. | |
| 5,263,224 | A | 11/1993 | Lovelady | |
| 5,355,549 | A | 10/1994 | Steinberg et al. | |
| 5,483,726 | A | 1/1996 | Blase et al. | |
| 5,551,119 | A | 9/1996 | Wörwag | |
| 5,551,120 | A | 9/1996 | Cipolla et al. | |
| 5,560,074 | A | 10/1996 | Graham et al. | |
| 5,564,160 | A | 10/1996 | Luebbering | |
| 5,615,448 | A | 4/1997 | Crouser et al. | |
| 5,784,755 | A | 7/1998 | Karr et al. | |
| 5,839,159 | A | 11/1998 | Karr et al. | |
| 5,887,313 | A | 3/1999 | Hanold et al. | |
| 5,896,617 | A | 4/1999 | Kasen et al. | |
| 5,933,912 | A | 8/1999 | Karr et al. | |
| 5,983,442 | A | 11/1999 | Louis et al. | |
| 6,079,077 | A | 6/2000 | Kakihara et al. | |
| 6,131,237 | A | 10/2000 | Kasper et al. | |
| 6,134,744 | A | 10/2000 | Kasen et al. | |
| 6,167,586 | B1 * | 1/2001 | Reed et al. | 15/320 |
| 6,167,587 | B1 | 1/2001 | Kasper et al. | |
| 6,230,362 | B1 | 5/2001 | Kasper et al. | |
| 6,279,196 | B2 | 8/2001 | Kasen et al. | |
| 6,286,181 | B1 | 9/2001 | Kasper et al. | |
| 6,412,141 | B2 | 7/2002 | Kasper et al. | |
| 6,438,793 | B1 | 8/2002 | Miner et al. | |
| 6,536,071 | B2 | 3/2003 | Zahuranec et al. | |
| 6,536,074 | B2 | 3/2003 | Boles et al. | |
| 6,609,269 | B2 | 8/2003 | Kasper | |
| 6,721,990 | B2 * | 4/2004 | Zahuranec et al. | 15/320 |
| 6,775,880 | B2 | 8/2004 | Kasper et al. | |
| 6,920,665 | B2 | 7/2005 | Tucker | |
| RE39,304 | E | 9/2006 | Kasen et al. | |
| 7,340,797 | B2 | 3/2008 | Theiss, Jr. et al. | |
| 7,363,681 | B2 | 4/2008 | Durbin et al. | |
| 7,392,566 | B2 | 7/2008 | Gordon et al. | |
| 7,475,712 | B2 | 1/2009 | McDowell | |
| 7,533,441 | B2 | 5/2009 | Yoo | |
| 7,555,810 | B2 | 7/2009 | Pullins et al. | |
| 7,559,112 | B2 | 7/2009 | Lee et al. | |
| 7,757,342 | B2 | 7/2010 | Gordon et al. | |
| 7,823,250 | B2 | 11/2010 | Vander Baan | |
| 7,908,705 | B2 | 3/2011 | VanderBaan | |
| 7,979,955 | B2 | 7/2011 | Lenkiewicz et al. | |
| 7,996,954 | B2 | 8/2011 | Lee et al. | |
| 2003/0024068 | A1 | 2/2003 | Tucker | |
| 2006/0185115 | A1 * | 8/2006 | Yoo | 15/331 |
| 2006/0230572 | A1 * | 10/2006 | Lee et al. | 15/334 |
| 2007/0234503 | A1 | 10/2007 | Krebs et al. | |
| 2009/0049641 | A1 | 2/2009 | Pullins et al. | |
| 2009/0113658 | A1 * | 5/2009 | Scott et al. | 15/322 |
| 2010/0005611 | A1 * | 1/2010 | Hong et al. | 15/300.1 |

OTHER PUBLICATIONS

Australian Patent Examination Report No. 1 for Application No. 2011295770 dated May 7, 2014 (3 pages).

* cited by examiner

CONVERSION MECHANISM FOR SWITCHING EXTRACTOR CLEANING MACHINE FROM FLOOR CLEANING TO HOSE CLEANING

CROSS-REFERENCE TO RELATED APPLICATION

This application claims the benefit of and priority to U.S. Provisional Patent Application No. 61/379,181, filed Sep. 1, 2010, the entire contents of which are hereby incorporated by reference.

BACKGROUND

The present invention relates to extractor cleaning machines, and more particularly to conversion mechanisms for switching extractor cleaning machines from a floor-cleaning mode to a hose-cleaning mode.

Extractor cleaning machines typically include a suction nozzle for floor cleaning in the floor-cleaning mode and an accessory hose for hose cleaning in the hose-cleaning mode. A conversion mechanism is used to switch from the floor-cleaning mode to the hose-cleaning mode.

SUMMARY

In some embodiments, the invention provides a surface cleaning machine including a base having a suction nozzle and a handle pivotally connected to the base. The handle includes an actuating surface and is pivotable between an upright hose-use position and an inclined floor-cleaning position. A hose is coupleable to the handle and a recovery tank is removably secured to the base. The recovery tank includes a hose inlet fluidly communicating with the hose when the recovery tank is secured to the base. The recovery tank also includes a collection chamber in fluid communication with the hose inlet, and a passage affording selective fluid communication between the suction nozzle and the collection chamber when the recovery tank is secured to the base. The recovery tank also includes a valve member that is moveable between a closed position where the valve substantially prevents fluid communication between the suction nozzle and the collection chamber and an open position that affords fluid communication between the suction nozzle and the collection chamber. An actuator is movable between a first position that allows the valve member to move to the open position and a second position that positions the valve member in the closed position. The actuator is biased toward the first position. As the handle is moved from the inclined floor-cleaning position to the hose-use position, the actuating surface contacts the actuator to move the actuator toward the second position and the actuator moves the valve member toward the closed position. When the handle is in the hose-use position the actuating surface holds the actuator in the second position and the actuator holds the valve member in the closed position.

The surface cleaning machine can be configured such that the passage includes an inlet in communication with the suction nozzle and an outlet in communication with the collection chamber. The valve member can be configured to substantially block the outlet when the valve member is in the closed position. The surface cleaning machine can be configured such that the recovery tank includes a tank base defining the collection chamber and a lid defining the passage, and the lid can be removably coupled to the tank base. The surface cleaning machine can be configured such that the lid includes a lid handle and the lid and the tank base are removable from the base as a unit by lifting the lid handle. The surface cleaning machine can be configured such that the actuator includes a first end engaging the valve member and a second end that is engaged by the actuating surface when the handle is moved to the hose-use position. The actuator and the valve member can be configured such that both are removable from the base with the recovery tank. The surface cleaning machine can be configured such that the actuator is slideably movable relative to the recovery tank between the first position and the second position. The surface cleaning machine can be configured such that the hose is blocked off when the hose is stored and opened when the hose is in use, and such that when the hose is in use and the handle is in the hose-use position, suction at an end of the hose is maximized because the valve member is in the closed position. The surface cleaning machine can be configured such that the tank base defines an air outlet, and such that a floor-cleaning airflow path is defined at least in part by the suction nozzle, the passage, the chamber, and the air outlet. The surface cleaning machine can be configured such that a hose-use airflow path is defined at least in part by the hose, the hose inlet, the chamber, and the air outlet.

In other embodiments, the invention provides a surface cleaning machine including a base having a suction nozzle and a handle pivotally connected to the base. The handle includes an actuating surface and is pivotable between an upright hose-use position and an inclined floor-cleaning position. A supply tank is removably secured to the handle, and a hose is fluidly connected to a hose inlet. The surface cleaning machine also includes a suction source, and a recovery tank that is removably secured to the base. The recovery tank includes a lid, a tank base, and a conversion mechanism. The lid includes a lid handle, a passage extending from a passage inlet to a passage outlet, and a valve member coupled to the lid for movement between a closed position where the valve member blocks the passage outlet and an open position. The tank base includes a chamber, an air outlet, the hose inlet, and a rearwardly-facing wall. The conversion mechanism includes an actuator assembly having an actuator base, an actuator, and a biasing element. The actuator assembly is secured to the rearwardly-facing wall of the tank base, and the actuator is movable within the actuator base between a first position for floor-cleaning and a second position for hose-use. The actuator is biased to the first position by the biasing element. The conversion mechanism also includes the actuating surface, which contacts the actuator to move the actuator toward the second position as the handle is moved from the floor-cleaning position to the hose-use position and to hold the actuator in the second position when the handle is in the hose-use position. The surface cleaning machine also includes a floor-cleaning airflow path extending between the suction source and the nozzle and formed at least in part by the nozzle, the passage, the chamber, and the air outlet. The surface cleaning machine further includes a hose-use airflow path extending between the suction source and the hose and formed at least in part by the hose, the hose inlet, the chamber, and the air outlet. The surface cleaning machine is configured such that the conversion mechanism moves the valve member to the closed position as the handle is moved to the hose-use position thereby blocking the passage outlet and the floor-cleaning airflow path.

The surface cleaning machine can be configured such that the recovery tank receptacle includes a stop and the recovery tank includes a notch. The notch and the stop can be in detent engagement with one another to retain the recovery tank within the recovery tank receptacle. The surface cleaning machine can be configured such that the actuator includes a first end and a second end, such that the first end engages the valve member and the second end extends through an opening in the rearwardly-facing wall of the tank base. The surface cleaning machine can be configured such that the lid, the tank base, and the conversion mechanism are removable from the recovery tank receptacle as a unit by lifting the lid handle.

In still other embodiments, the invention provides a surface cleaning machine including a base having a suction nozzle and a handle pivotally coupled to the base and moveable between a substantially upright position and an inclined position. The surface cleaning machine also includes a suction source and a removable recovery tank. The recovery tank defines a collection chamber in fluid communication with the suction source when the recovery tank is coupled to the surface cleaning machine. The recovery tank includes a passage having an inlet in communication with the suction nozzle when the recovery tank is coupled to the surface cleaning machine. The recovery tank also includes a valve member moveable between a closed position that interrupts fluid communication between the passage and the collection chamber and an open position affording fluid communication between the passage and the collection chamber. The surface cleaning machine is configured such that movement of the handle to the substantially upright position moves the valve member to the closed position, and such that movement of the handle to the inclined position allows movement of the valve member to the open position.

The surface cleaning machine can be configured such that the recovery tank further includes an actuator having a first end engaging the valve member and a second end that is engaged by the handle when the handle is in the substantially upright position. The actuator and the valve member can both be removable from the surface cleaning machine with the recovery tank. The surface cleaning machine can be configured such that the actuator is slideably movable relative to the recovery tank and movable between a retracted position associated with the closed position of the valve member and an extended position associated with the open position of the valve member. The handle can be configured to move the actuator from the extended position to the retracted position when the handle is moved from the inclined position to the substantially upright position. The surface cleaning machine can be configured such that the handle includes an actuating surface that engages the second end of the actuator when the handle is in the substantially upright position. The surface cleaning machine can be configured such that the recovery tank further includes a tank base portion and a lid portion releasably coupled to the tank base portion. The tank base portion can define the collection chamber and the lid portion can define the passage. The surface cleaning machine can also include an accessory hose in fluid communication with the collection chamber and the suction source. The accessory hose can be blocked off when the accessory hose is stored and opened when the accessory hose is in use. When the accessory hose is in use and the handle is in the substantially upright position, suction at the end of the accessory hose can be substantially maximized because the valve member is in the closed position. The surface cleaning machine can be configured such that he recovery tank includes an air outlet in fluid communication with the suction source and a hose inlet, and such that the air outlet and the hose inlet both fluidly communicate with the collection chamber. A hose-use airflow path can be formed at least in part by the accessory hose, the hose inlet, the collection chamber, and the air outlet. The surface cleaning machine can be configured such that the recovery tank includes an air outlet affording fluid communication between the suction source and the collection chamber, and such that a floor-cleaning airflow path is formed at least in part by the suction nozzle, the passage, the collection chamber, and the air outlet. The surface cleaning machine can be configured such that the recovery tank is removably coupled to the base. The surface cleaning machine can be configured such that the base includes a recovery tank receptacle that removably receives the recovery tank. The surface cleaning machine can be configured such that the recovery tank receptacle defines a stop and the recovery tank includes a notch. The notch and the stop can be in detent engagement to retain the recovery tank within the recovery tank receptacle. The surface cleaning machine can be configured such that the passage includes an outlet that opens into the collection chamber, and such that the valve member covers the outlet when the valve member is in the closed position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
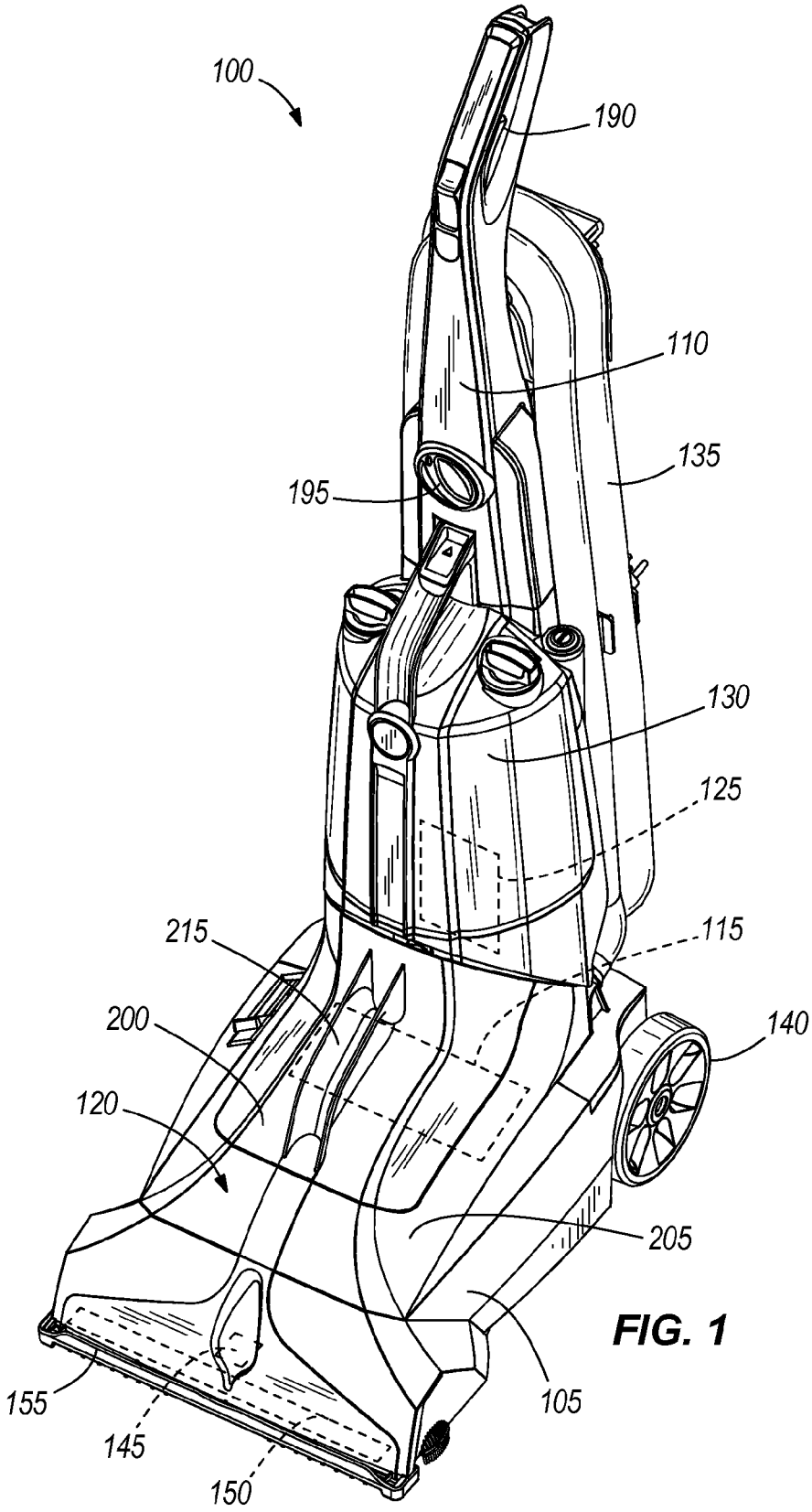
FIG. 1 is a perspective view of an extractor cleaning machine or extractor.

FIG. 1 illustrates an extractor-type surface cleaning machine 100 (hereinafter referred to simply as an "extractor"). In the illustrated embodiment, the extractor 100 is an upright extractor operable to clean a surface, such as, for example, a floor. In some embodiments, the extractor 100 is adapted to clean a variety of surfaces, such as carpets, hardwood floors, tiles, or the like. The extractor 100 distributes or sprays a cleaning fluid (e.g., water, detergent, or a mixture of water and detergent) onto the surface to clean the surface. The extractor 100 then draws the cleaning fluid and any dirt off of the surface, leaving the surface relatively clean and dry. Although the following description refers specifically to an upright extractor-type surface cleaning machine that sprays a cleaning fluid onto the surface to be cleaned, the present invention can also be incorporated in or applied to dry vacuum cleaners.

The extractor 100 includes a base in the form of a foot 105 (a non-upright extractor 100 might have a different type of base), a handle 110 coupled to the foot 105, a suction source 115 supported by the foot 105, a recovery tank 120 removably secured to the foot 105, a distributor 125 supported by the handle 110, a supply tank assembly 130 removably secured to the handle 110, and an accessory hose 135. In other embodiments, the supply tank assembly 130 can be removably secured to the foot 105 and the recovery tank 120 can be removably secured to the handle 110, or the supply tank assembly 130 and the recovery tank 120 can both be removably secured to either the foot 105 or the handle 110. Embodiments of the invention incorporated into a dry vacuum will not include the supply tank assembly 130 or the distributor 125. The foot 105 is movable along the surface to be cleaned and supports the other components of the extractor 100. Two wheels 140 (only one of which is shown in FIG. 1) are coupled to the foot 105 to facilitate movement of the foot 105 along the surface. In the illustrated embodiment, the wheels 140 are idle wheels. In another embodiment, the wheels 140 may be driven wheels.

The foot 105 includes a distribution nozzle 145, a suction nozzle 150, and a brush assembly 155. The distribution nozzle 145 is coupled to a lower surface of the foot 105 to direct cleaning fluid toward the surface. Embodiments of the invention incorporated into a dry vacuum will not include a distribution nozzle 145. The suction nozzle 150 is also coupled to the lower surface of the foot 105 to draw fluid and dirt from the surface back into the recovery tank 120 of the extractor 100. The brush assembly 155 is coupled to the lower surface of the foot 105 adjacent the distribution nozzle 145 and the suction nozzle 150 to scrub the surface being cleaned. The brush assembly 155 also helps inhibit fluid from flowing beyond a periphery of the foot 105. In some embodiments, individual brushes of the brush assembly 155 may be electrically or pneumatically rotated to agitate and scrub the surface being cleaned.

The suction source 115 is in fluid communication with the suction nozzle 150 to draw fluid and dirt from the surface being cleaned through the suction nozzle 150. In one embodiment, the suction source 115 includes a fan that generates a vacuum to draw the fluid and dirt through the suction nozzle 150. In the illustrated embodiment, the suction source 115 is supported by the foot 105 generally underneath the recovery tank 120. In other embodiments, the suction source 115 may be supported by the handle 110 or may be positioned elsewhere on the extractor 100.

In the illustrated extractor-type surface cleaning machine 100, the distributor 125 is in fluid communication with the distribution nozzle 145 to draw cleaning fluid from the supply tank assembly 130 and distribute the cleaning fluid to the surface to be cleaned through the distribution nozzle 145. In one embodiment, the distributor 125 draws two separate cleaning fluids (e.g., water and detergent) from the supply tank assembly 130, mixes the fluids, and distributes the mixed cleaning fluid onto the surface. In some embodiments, the distributor 125 may include a pump that propels the cleaning fluid to the distribution nozzle 145. In the illustrated embodiment, the distributor 125 is supported by the handle 110 generally behind the supply tank assembly 130. In other embodiments, the distributor 125 may be supported by the foot 105 or may be positioned elsewhere on the extractor 100.

Figure 2:
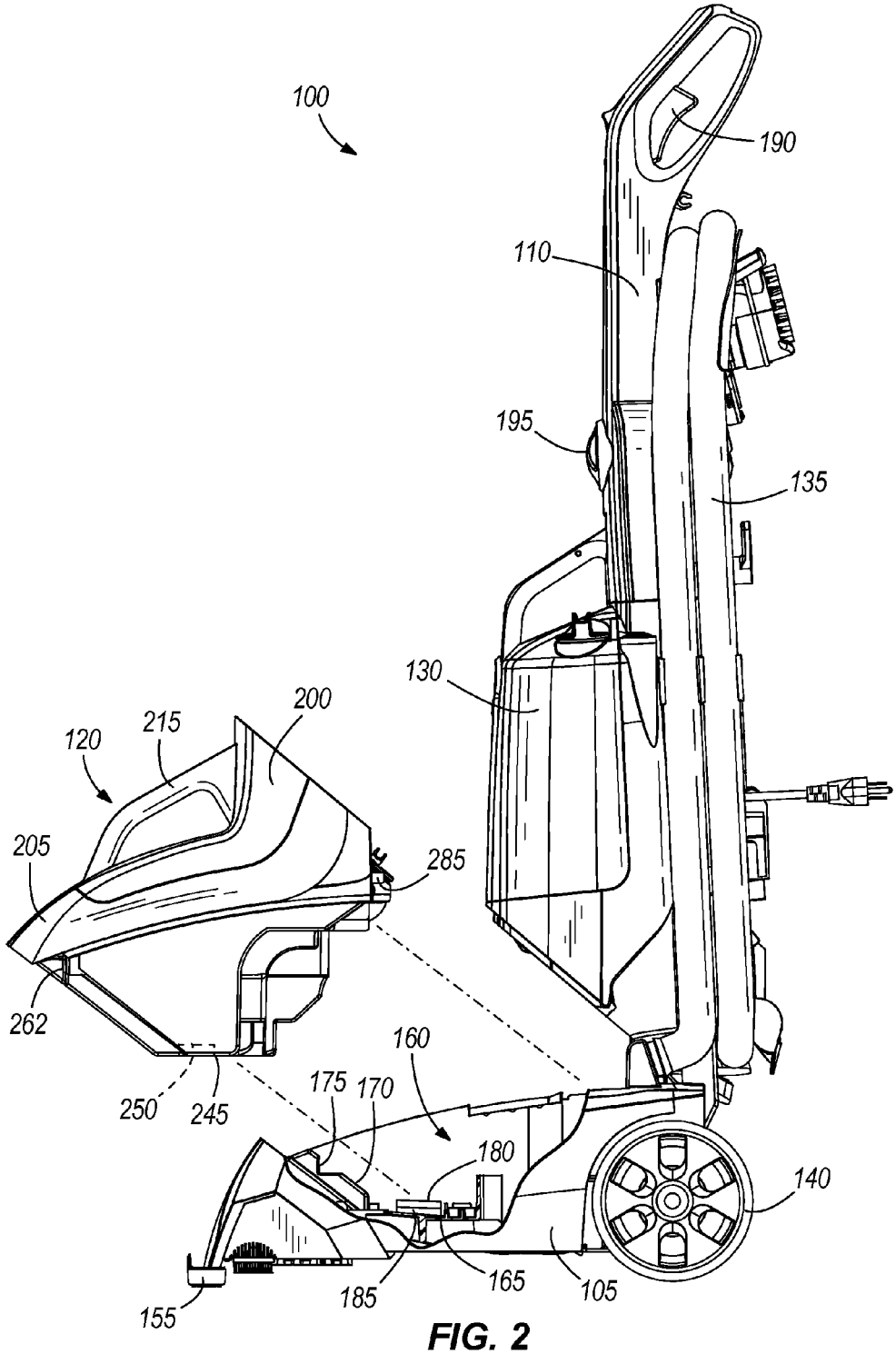
FIG. 2 is a side view of the extractor of FIG. 1 with a recovery tank shown removed from a recovery tank receptacle.
Figure 3:
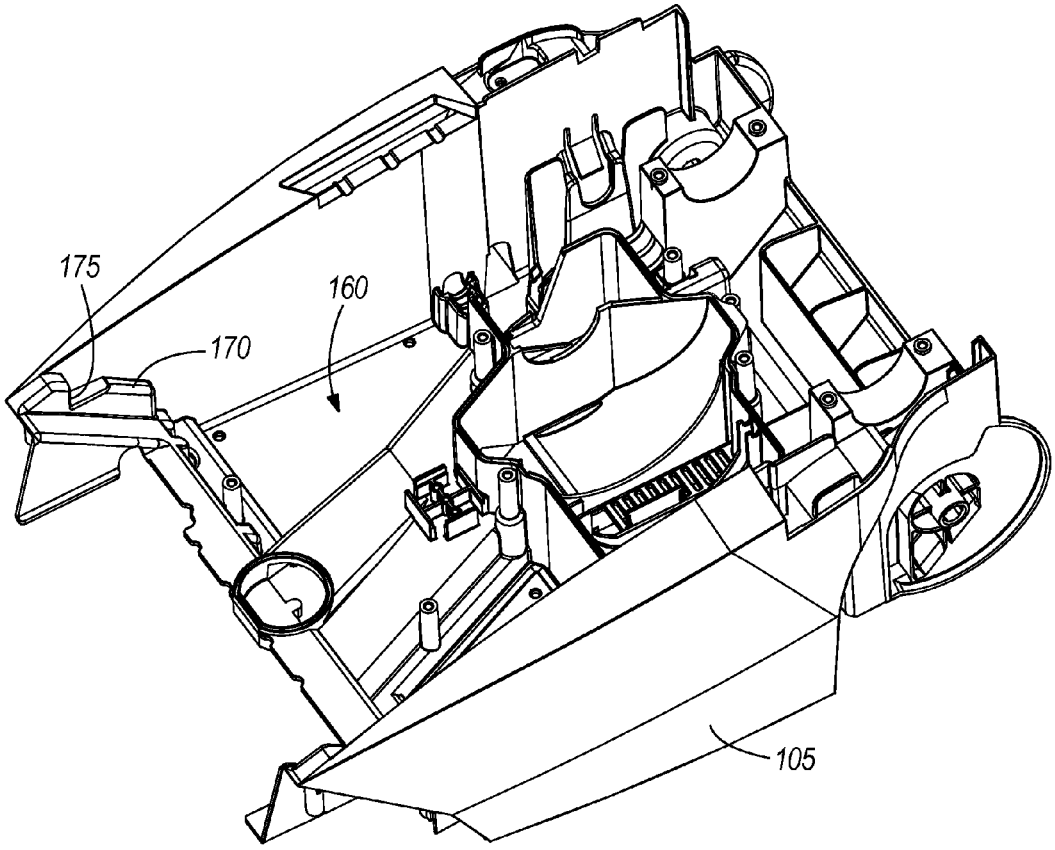
FIG. 3 is a perspective view of a portion of a base or foot of the extractor of FIG. 1.

As shown in FIGS. 2 and 3, the foot 105 also includes a recovery tank receptacle 160 including a lower surface 165 and a guide surface 170. The guide surface 170 includes a stop 175. A magnet 180 and a metal plate 185 are secured to the lower surface 165 with the magnet 180 positioned above the metal plate 185. The metal plate 185 is ferromagnetic.

Figure 4:
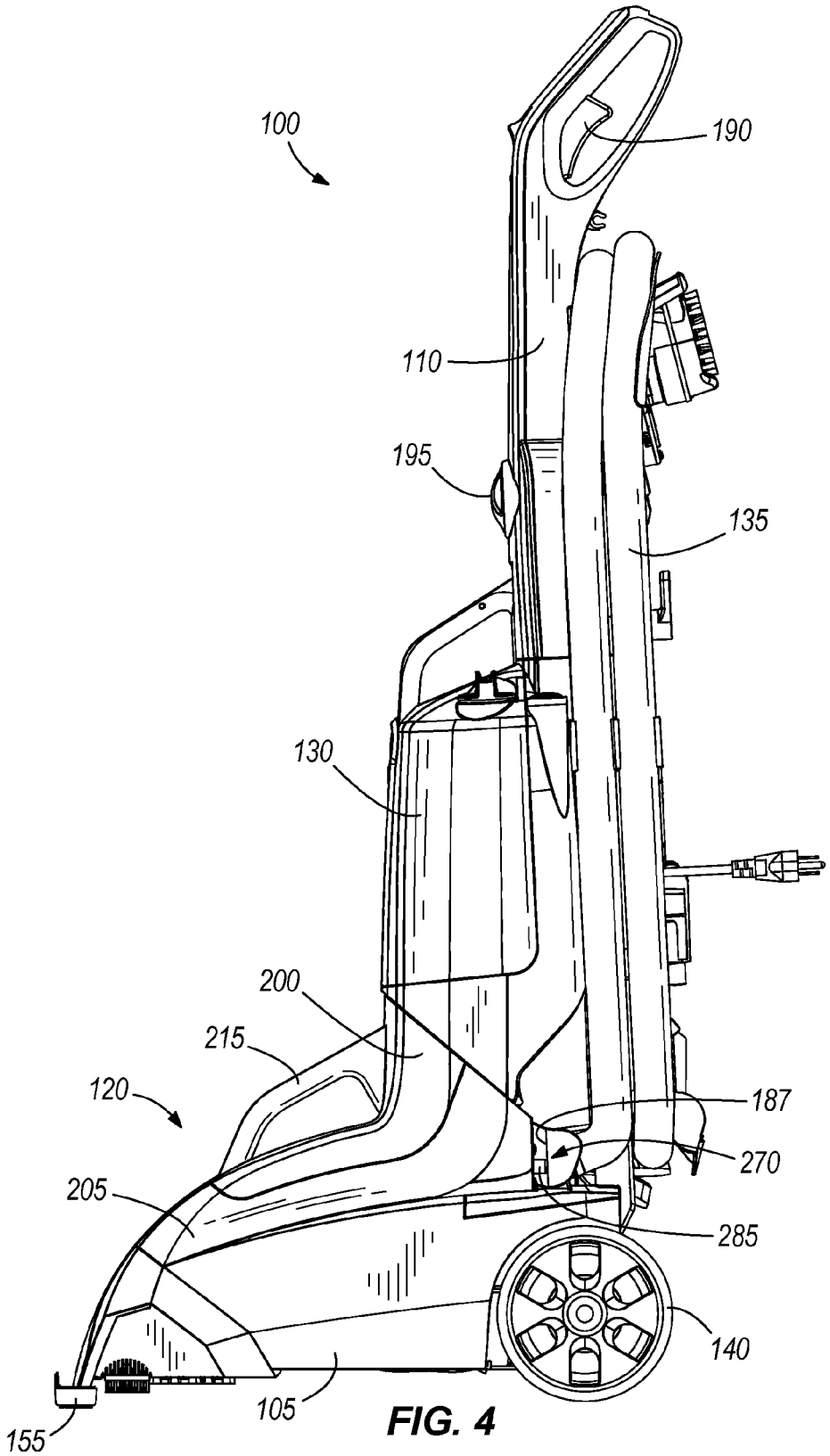
FIG. 4 is a side view of the extractor of FIG. 1 in an upright or hose-use position including a cut-away portion showing a conversion mechanism.
Figure 5:
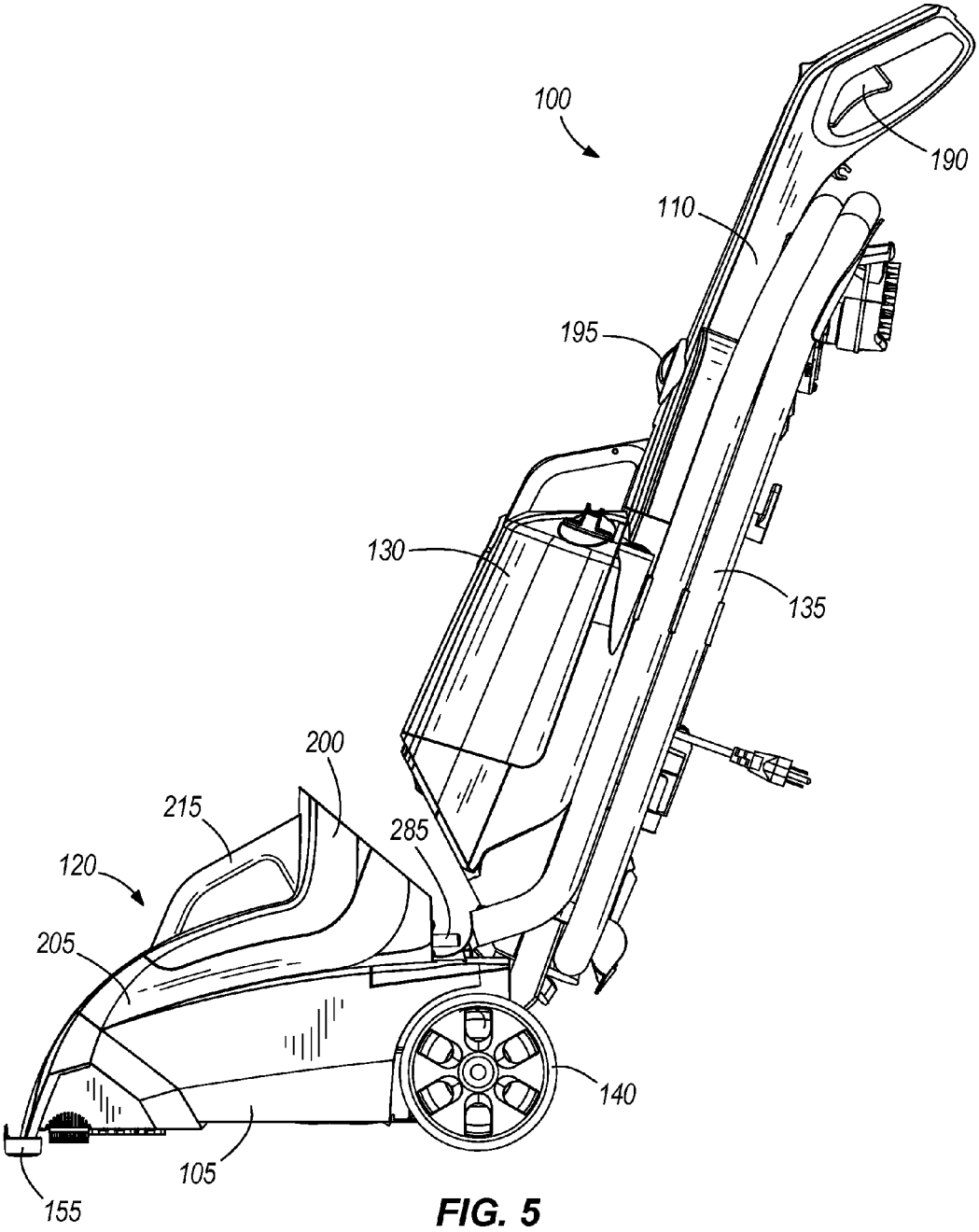
FIG. 5 is a side view of the extractor of FIG. 1 in an inclined or floor-cleaning position including a cut-away portion showing the conversion mechanism.

As shown in FIGS. 4 and 5, the handle 110 is pivotally coupled to and extends from the foot 105. The handle 110 includes an actuating surface 187 (shown in FIG. 4). The handle 110 is pivotable or tiltable relative to the foot 105 from a generally vertical, upright, or hose-cleaning or hose-use position (shown in FIG. 4) to an infinite number of non-vertical or inclined floor-cleaning positions (shown in FIG. 5). Pivoting the handle 110 to a floor-cleaning position facilitates moving the foot 105 along the surface.

As shown in FIG. 1, the handle 110 includes a trigger 190 and a mode knob 195. The trigger 190 is actuatable to spray cleaning fluid from the supply tank assembly 130 through the distribution nozzle 145 and onto the surface. An on/off switch turns the extractor 100 (and more particularly the suction source 115 and the distributor 125) on and off. The mode knob 195 adjusts the operating mode of the extractor 100. For example, the mode knob 195 may be rotated to control the amount of cleaning fluid distributed by the extractor 100 onto the surface. The handle 110 also supports the accessory hose 135. The accessory hose 135 is connectable to a variety of hand-held tools to help clean smaller surfaces, such as, for example, steps.

Figure 6:
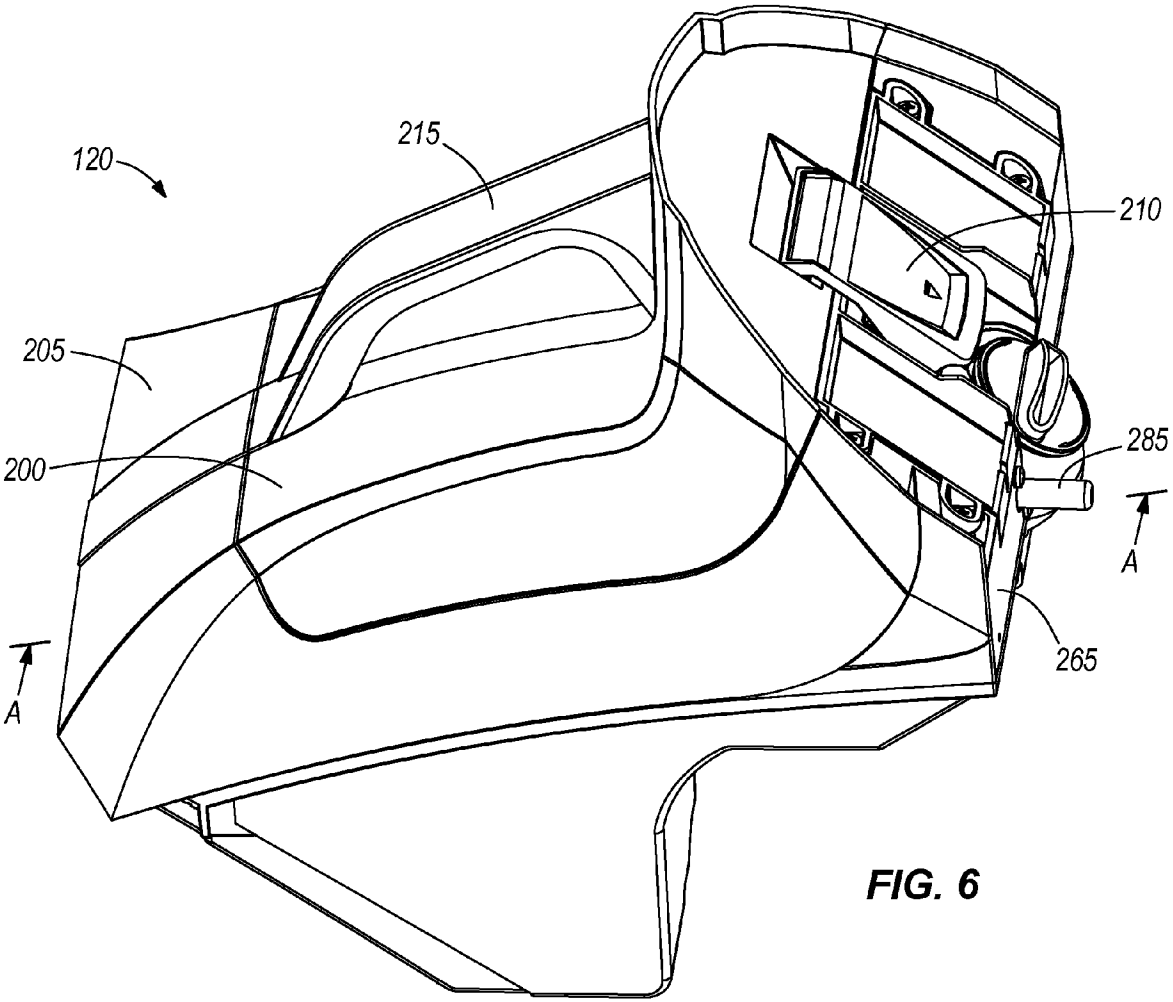
FIG. 6 is a perspective view of the recovery tank of FIG. 2.
Figure 7:
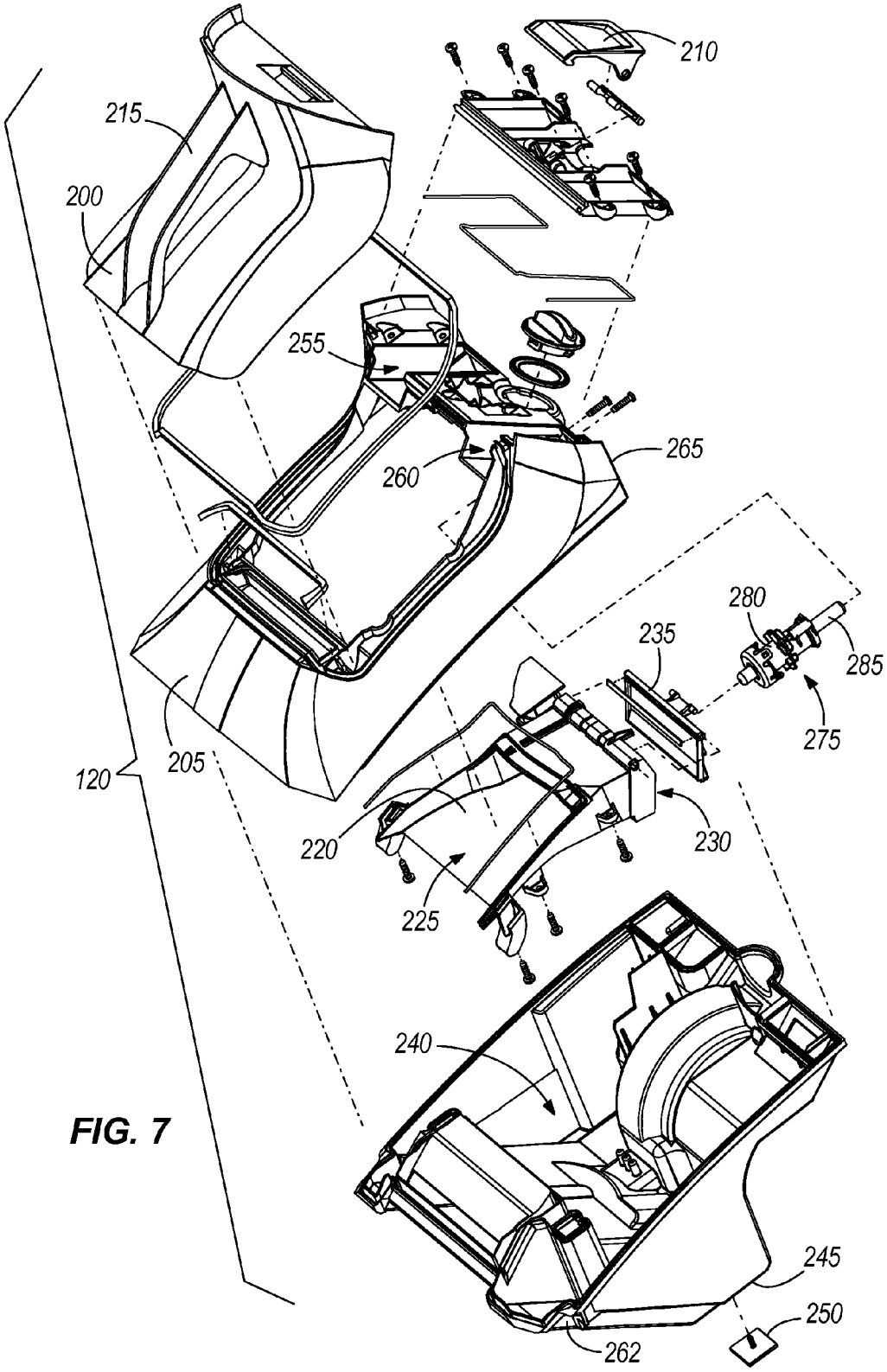
FIG. 7 is an exploded view of the recovery tank of FIG. 6.

As shown in FIG. 2, the recovery tank 120 is removably secured at least partially within the recovery tank receptacle 160. As shown in FIGS. 6 and 7, the recovery tank 120 includes a lid 200, a base 205, and a latch mechanism 210. The latch mechanism 210 is secured to the base 205 and is used to selectively secure the lid 200 to the base 205. As shown in FIG. 7, the lid 200 includes a handle 215, a passage 220 extending between a passage inlet 225 and a passage outlet 230, and a valve member 235 pivotally connected to the lid 200. The valve member 235 is positioned at the passage outlet 230 and pivots between a closed position (shown in FIG. 9) where the valve member 235 covers or blocks the passage outlet 230 to inhibit a fluid flow through the passage outlet 230 and a number of open positions (shown in FIG. 8) where the valve member 235 allows a fluid flow through the passage outlet 230. Other embodiments of the invention may position the valve member 235 at different locations along the passage 220. As shown in FIG. 7, the base 205 includes a collection chamber 240, a bottom surface 245, a metal plate 250 secured to the bottom surface 245, an air outlet 255, a hose inlet 260, a rear wall 265, and a notch 262. The metal plate 250 is ferromagnetic. When the recovery tank 120 is secured within the recovery tank receptacle 160, the passage 220 is in fluid communication with the suction nozzle 150 and allows cleaning fluid and dirt to pass from the suction nozzle 150 to the collection chamber 240 when the valve member 235 is in the open position. In the illustrated embodiment, the recovery tank 120 is secured within the recovery tank receptacle 160 by detent engagement between the notch 262 and the stop 175. The illustrated recovery tank is further secured within the recovery tank receptacle 160 by the magnetic engagement between the metal plate 250 and the magnet 180 and metal plate 185 of the recovery tank receptacle 160. Sandwiching the magnet 180 between the metal plate 185 and the metal plate 250 increases the strength of the magnetic engagement. Alternatively, the metal plate 250 can be replaced with a second magnet. Other embodiments may not include the illustrated magnet 180 and may rely solely on the detent engagement provided by engagement of the notch 262 and the and may instead include latches, springs, detent mechanisms, or other suitable devices configured to retain the recovery tank 120 within the recovery tank receptacle 160. Still other embodiments may include the magnet 180 and additional latches, springs, detent mechanisms, and the like for retaining the recovery tank 120.

Figure 8:
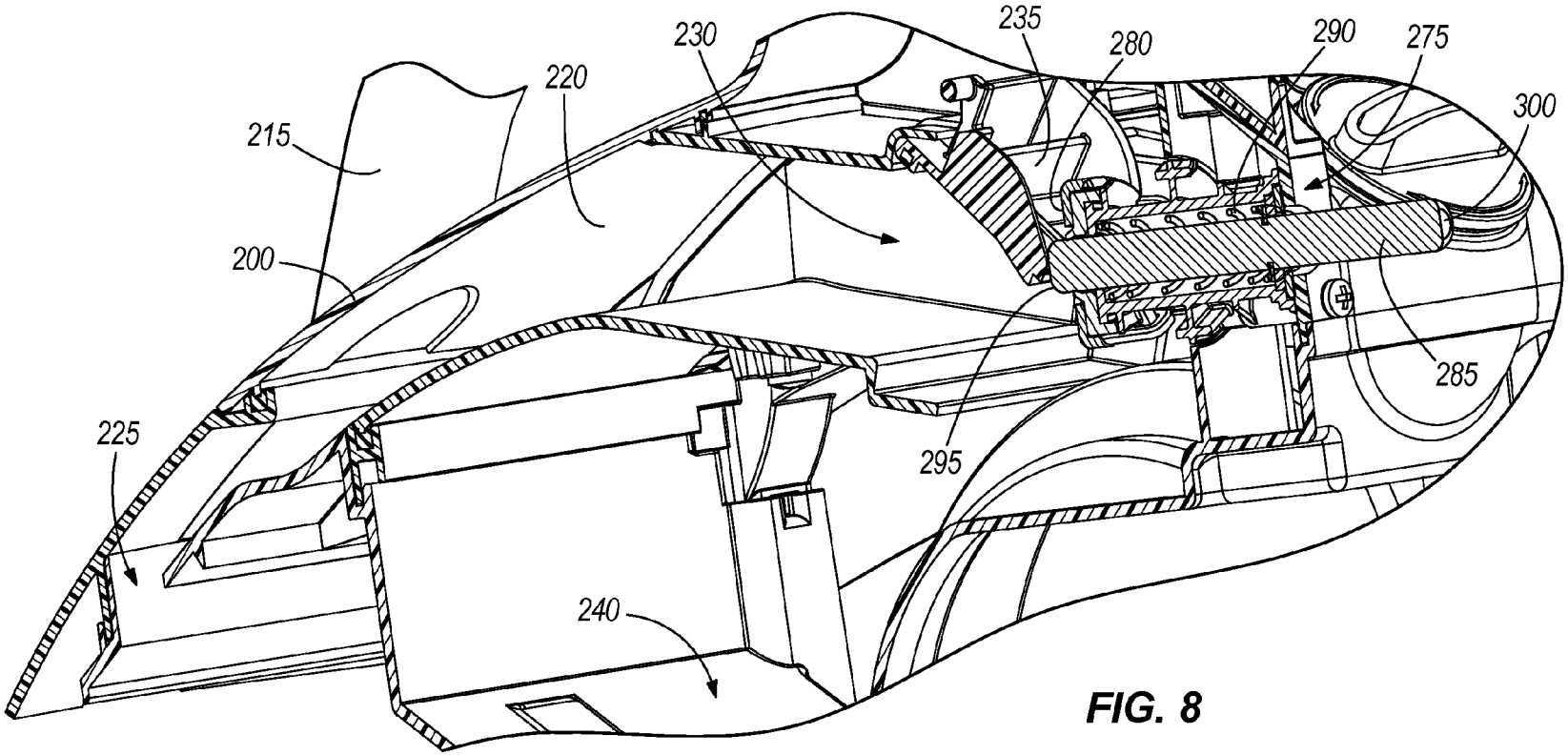
FIG. 8 is a perspective, sectional view along line A-A of the recovery tank of FIG. 6 showing a valve member in an open position and an actuator in a hose-use position.
Figure 9:
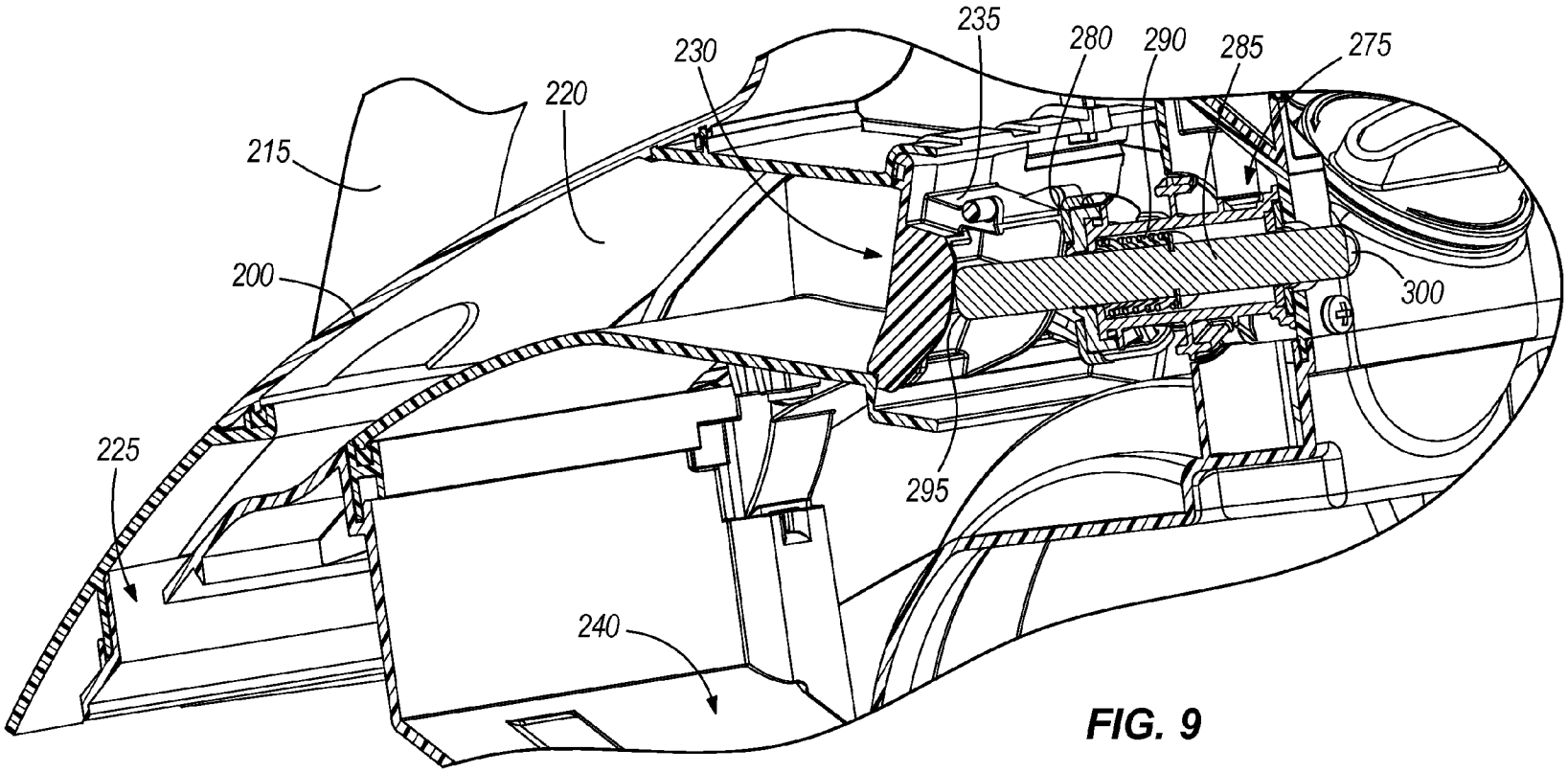
FIG. 9 is a perspective, sectional view along line A-A of the recovery tank of FIG. 6 showing the valve member in a closed position and the actuator in a floor-cleaning position.

A conversion mechanism 270 (FIG. 4) includes a first portion associated with the foot 105 and a second portion associated with the handle 110. In the illustrated embodiment, the first portion includes an actuator assembly 275 (shown in FIGS. 7-9) and the second portion includes the actuating surface 187 (shown in FIG. 3). As shown in FIGS. 8-9, the illustrated actuator assembly 275 includes an actuator base 280, an actuator 285 slideably supported by the base 280, and a biasing element 290. Other embodiments may include an actuator 285 that is moveable in a different manner, such as pivotal movement, rotational movement, or combinations of pivotal and translational movement. The actuator assembly base 280 is secured to the rear wall 265 of the recovery tank base 205. The actuator 285 includes a first end 295 and a second end 300 and is movable within the actuator base 280 between an extended, floor-cleaning position (shown in FIG. 8) and a retracted, hose-cleaning or hose-use position (shown in FIG. 9). The biasing element 290, shown as a spring, biases the actuator 285 toward the extended floor-cleaning position. As shown in FIG. 6, when in the extended floor-cleaning position, the actuator 285 extends through an opening in the rear wall 265 of the recovery tank base 205.

The actuator 285 is moved between the extended, floor-cleaning position and the retracted, hose-use position by pivotal movement of the handle 110. When the handle 110 is in the upright or hose-use position (see FIG. 4), the actuating surface 187 of the handle 110 is engaged with the second end 300 of the actuator 285 and holds the actuator 285 in the refracted position such that the first end 295 of the actuator 285 contacts the valve member 235 and in turn holds the valve member 235 in the closed position. As the handle 110 is moved from the upright, hose-use position to an inclined, floor-cleaning position (see FIG. 5), the actuating surface 187 of the handle 110 moves generally rearwardly and away from the actuator base 280, thereby allowing the biasing element 290 to move the actuator 285 toward the extended, floor-cleaning position (FIG. 8). As the actuator 285 moves toward the extended, floor cleaning position, the valve member 235 moves toward the open position. In some embodiments the valve member 235 is biased toward the open position, while in other embodiments the valve member 235 moves to the open position under the influence of a pressure differential created by the suction source 115. Generally speaking, when in the floor-cleaning position, the first end 295 of the actuator 285 is closer to the rear wall 265 than it is in the hose-use position, thereby freeing the valve member 235 to move to the open position. As mentioned above, alternative embodiments my include a recovery tank 120 supported by the handle 110, in which case the components will be reversed such that the actuating surface 187 is positioned on the foot 105 and the actuator 285 moves with the handle 110 into and out of engagement with the actuating surface 187.

During use, the suction source 115 creates an airflow to draw cleaning fluid and dirt into the extractor 100. When the handle 110 is in the inclined floor-cleaning position and the valve member 235 is in the open position, a floor-cleaning airflow path is defined and used for floor cleaning. The floor-cleaning airflow path is at least partially defined by the suction nozzle 150, the passage 220, passage outlet 230, the collection chamber 240, and the air outlet 255. During floor cleaning the passage outlet 230 communicates with the collection chamber 240 because the valve 235 is in the open position. Debris on the surface to be cleaned, such as cleaning fluid and dirt, is drawn by the airflow into the suction nozzle 150 and then into the passage 220. As shown in FIGS. 8 and 9, the passage 220 increases in cross-sectional area from the passage inlet 225 to the passage outlet 230 to aid in separating the cleaning fluid and dirt from the airflow. After the combined flow of air, cleaning fluid, and dirt pass through the passage outlet 230, the cleaning fluid and dirt are collected in the collection chamber 240 and the air exits the recovery tank 120 through the air outlet 255. From the air outlet 255, the air flow passes through the suction source 115 and is then exhausted from the extractor 100.

When the handle 110 is in the upright hose-use position and the valve member 235 is in the closed position, a hose-use airflow path is defined and used for cleaning a surface using the accessory hose 135. The hose-use airflow path is at least partially defined by the accessory hose 135, the hose inlet 260, the collection chamber 240, and the air outlet 255. After cleaning fluid is supplied to the surface to be cleaned, the cleaning fluid and dirt from that surface are drawn by the airflow into the accessory hose 135 and then through the hose inlet 260 to the collection chamber 240. The cleaning fluid and dirt are collected in the collection chamber 240 and the air exits the recovery tank 120 through the air outlet 255. From the air outlet 255, the air flow passes through the suction source 115 and is then exhausted from the extractor 100. When the accessory hose 135 is not being used for hose cleaning, the accessory hose 135 is secured to the handle 110 in a manner that closes off the end of the accessory hose 135, thereby blocking the hose-use airflow path. More specifically, the handle 110 is provided with a boss or projection (not shown) over which the end of the accessory hose 135 closely fits. The shape or cross-section of the boss or projection is chosen to correspond with the shape or cross section of the end of the accessory hose 135.

To use the suction nozzle 150 to clean a surface, the handle 110 is pivoted to an inclined floor-cleaning position (as shown in FIG. 4) and the conversion mechanism 270 frees the valve member 235 to move to the open position. By pivoting the handle 110 to the floor cleaning position, the actuating surface 187 of the handle 110 is moved away from the recovery tank 120, allowing the actuator 285 to move to the floor-cleaning position. Moving the actuator 285 to the floor cleaning position frees the valve member 235 to move to the open position. The vacuum created by the suction source 115 through the floor-cleaning airflow path pulls the valve member 235 to the open position, thereby opening the floor-cleaning airflow path. Some embodiments may also include a biasing member that biases the valve member 235 toward the open position. Although vacuum is supplied to both the floor-cleaning airflow path and the hose-use airflow path when the valve member 235 is in the floor-cleaning position, dirt and fluid will be drawn in through the floor-cleaning airflow path because when the accessory hose 135 secured to the handle 110 for storage the end of the hose 135 is blocked off, as described above.

To use the accessory hose 135 to clean a surface, the handle 110 is pivoted to the upright hose-use position (as shown in FIG. 3) and the conversion mechanism 270 moves the valve member 235 to the closed position. By pivoting the handle 110 to the hose-use position, the actuating surface 187 of the handle 110 is moved towards the recovery tank 120 and pushes the actuator 285 into the hose-use position. Moving the actuator 285 into the hose-use position pushes the first end 295 of the actuator 285 against the valve member 235 to move the valve member 235 into the closed position, thereby closing the floor-cleaning airflow path. The detent engagement between the notch 262 of the recovery tank 120 and the stop 175 of the recovery tank receptacle 160 aids in preventing the conversion mechanism 270 from pushing the recovery tank

120 out of the recovery tank receptacle 160 when the handle 110 is pivoted to the hose-use position. In embodiments that include the magnet 180 and metal plate 185, the magnet 180 and metal plate 185 help to further inhibit the conversion mechanism 270 from pushing the recovery tank 120 out of the recovery tank receptacle. The accessory hose 135 is then removed from the handle 110 thereby opening the end of the hose 135 such that cleaning fluid and dirt can be sucked into the end of the hose 135 due to communication of the accessory hose 135 with the suction source 115 by way of the collection chamber 240. The accessory hose 135 can be used with or without any of the variety of hand-held tool attachments that generally are provided with the extractor 100. Because the valve member 235 is in the closed position the accessory hose 135 represents the flow path of least resistance for the suction source 115 and the suction at the end of the accessory hose 135 is therefore maximized.

While the conversion mechanism 270 described above includes a plunger-type mechanism whereby the actuator 285 is slideably moveable with respect to the actuator base 180, a variety of other conversion mechanisms 270 of different configurations may also be utilized without departing from the spirit and scope of the invention. For example, the conversion mechanism 270 may include an actuator in the form of a pivoting link or linkage arrangement whereby one end of the link or linkage engages the valve member 235 and another end of the link or linkage engages the handle 110 such that movement of the link or links opens and closes the valve member 235 in response to pivotal movement of the handle. Other embodiments may include an electro-mechanical conversion mechanism 270 or actuator whereby one end of the mechanism includes a switch whereby pivotal movement of the handle opens and closes a switch that in turn activates the other end of the mechanism which includes a suitably configured actuator to open or close the valve member 235.

Various features of the invention are set forth in the following claims.

What is claimed is:

1. A surface cleaning machine comprising:

a base including a suction nozzle;

a handle pivotally connected to the base, the handle including an actuating surface and pivotable between an upright hose-use position and an inclined floor-cleaning position;

a hose coupleable to the handle;

a recovery tank, the recovery tank removably secured to the base and including a hose inlet fluidly communicating with the hose when the recovery tank is secured to the base, a collection chamber in fluid communication with the hose inlet, and a passage affording selective fluid communication between the suction nozzle and the collection chamber when the recovery tank is secured to the base, the recovery tank further including a valve member moveable between a closed position where the valve substantially prevents fluid communication between the suction nozzle and the collection chamber and an open position that affords fluid communication between the suction nozzle and the collection chamber, and an actuator that is movable between a first position that allows the valve member to move to the open position and a second position that positions the valve member in the closed position, the actuator biased toward the first position, wherein as the handle is moved from the inclined floor-cleaning position to the hose-use position, the actuating surface contacts the actuator to move the actuator toward the second position and the actuator moves the valve member toward the closed position, and wherein when the handle is in the hose-use position, the actuating surface holds the actuator in the second position and the actuator holds the valve member in the closed position.

2. The surface cleaning machine of claim 1, wherein the passage includes an inlet in communication with the suction nozzle and an outlet in communication with the collection chamber, and wherein the valve member substantially blocks the outlet when the valve member is in the closed position.

3. The surface cleaning machine of claim 1, wherein the recovery tank includes a tank base defining the collection chamber and a lid defining the passage, and wherein the lid is removably coupled to the tank base.

4. The surface cleaning machine of claim 3, wherein the lid includes a lid handle and wherein the lid and the tank base are removable from the base as a unit by lifting the lid handle.

5. The surface cleaning machine of claim 1, wherein the actuator includes a first end engaging the valve member and a second end that is engaged by the actuating surface when the handle is moved to the hose-use position, and wherein the actuator and the valve member are both removable from the base with the recovery tank.

6. The surface cleaning machine of claim 1, wherein the actuator is slideably movable relative to the recovery tank between the first position and the second position.

7. The surface cleaning machine of claim 1, wherein the hose is blocked off when the hose is stored and opened when the hose is in use, and wherein when the hose is in use and the handle is in the hose-use position, suction at an end of the hose is maximized because the valve member is in the closed position.

8. The surface cleaning machine of claim 1, wherein the recovery tank includes a tank base defining an air outlet, and wherein a floor-cleaning airflow path is defined at least in part by the suction nozzle, the passage, the chamber, and the air outlet.

9. The surface cleaning machine of claim 1, wherein a hose-use airflow path is defined at least in part by the hose, the hose inlet, the chamber, and the air outlet.

10. A surface cleaning machine comprising:

a base including a suction nozzle;

a handle pivotally connected to the base, the handle including an actuating surface and pivotable between an upright hose-use position and an inclined floor-cleaning position;

a supply tank removably secured to the handle;

a hose fluidly connected to a hose inlet;

a suction source;

a recovery tank removably secured to the base, the recovery tank including:

a lid, the lid including a lid handle, a passage extending from a passage inlet to a passage outlet, and a valve member coupled to the lid for movement between a closed position where the valve member blocks the passage outlet and an open position, a tank base, the tank base including a chamber, an air outlet, the hose inlet, and a rearwardly-facing wall, and a conversion mechanism, the conversion mechanism including:

an actuator assembly including an actuator base, an actuator, and a biasing element, the actuator assembly secured to the rearwardly-facing wall of the tank base, the actuator movable within the actuator base between a first position for floor-cleaning and a second position for hose-use, and the actuator biased to the first position by the biasing element, and the actuating surface contacting the actuator to move the actuator toward the second position as the handle is moved from the floor-cleaning position to the hose-use position and to hold the actuator in the second position when the handle is in the hose-use position;

a floor-cleaning airflow path extending between the suction source and the nozzle and formed at least in part by the nozzle, the passage, the chamber, and the air outlet; and a hose-use airflow path extending between the suction source and the hose and formed at least in part by the hose, the hose inlet, the chamber, and the air outlet;

wherein the conversion mechanism moves the valve member to the closed position as the handle is moved to the hose-use position, thereby blocking the passage outlet and the floor-cleaning airflow path.

11. The surface cleaning machine of claim 10, wherein the base includes a recovery tank receptacle including a stop and the recovery tank includes a notch, the notch and the stop in detent engagement to retain the recovery tank within the recovery tank receptacle.

12. The surface cleaning machine of claim 10, wherein the actuator includes a first end and a second end, wherein the first end engages the valve member, and wherein the second end extends through an opening in the rearwardly-facing wall of the tank base.

13. The surface cleaning machine of claim 10, wherein the base includes a recovery tank receptacle, wherein the lid, the tank base, and the conversion mechanism are removable from the recovery tank receptacle as a unit by lifting the lid handle.

14. A surface cleaning machine comprising:

a base including a suction nozzle;

a handle pivotally coupled to the base and moveable between a substantially upright position and an inclined position;

a suction source; and a removable recovery tank, the recovery tank defining a collection chamber in fluid communication with the suction source when the recovery tank is coupled to the surface cleaning machine, the recovery tank including a passage having an inlet in communication with the suction nozzle when the recovery tank is coupled to the surface cleaning machine, the recovery tank also including a valve member moveable between a closed position that interrupts fluid communication between the passage and the collection chamber and an open position affording fluid communication between the passage and the collection chamber, wherein movement of the handle to the substantially upright position moves the valve member to the closed position, and wherein movement of the handle to the inclined position allows movement of the valve member to the open position.

15. The surface cleaning machine of claim 14, wherein the recovery tank further includes an actuator, the actuator having a first end engaging the valve member and a second end that is engaged by the handle when the handle is in the substantially upright position, wherein the actuator and the valve member are both removable from the surface cleaning machine with the recovery tank.

16. The surface cleaning machine of claim 15, wherein the actuator is slideably movable relative to the recovery tank and movable between a retracted position associated with the closed position of the valve member and an extended position associated with the open position of the valve member, and wherein the handle moves the actuator from the extended position to the retracted position when the handle is moved from the inclined position to the substantially upright position.

17. The surface cleaning machine of claim 16, wherein the handle includes an actuating surface that engages the second end of the actuator when the handle is in the substantially upright position.

18. The surface cleaning machine of claim 14, wherein the recovery tank further includes a tank base portion and a lid portion releasably coupled to the tank base portion, the tank base portion defining the collection chamber and the lid portion defining the passage.

19. The surface cleaning machine of claim 14, further comprising an accessory hose in fluid communication with the collection chamber and the suction source, the accessory hose blocked off when the accessory hose is stored and opened when the accessory hose is in use, and wherein when the accessory hose is in use and the handle is in the substantially upright position, suction at the end of the accessory hose is substantially maximized because the valve member is in the closed position.

20. The surface cleaning machine of claim 19, wherein the recovery tank includes an air outlet in fluid communication with the suction source and a hose inlet, the air outlet and the hose inlet both fluidly communicating with the collection chamber, and wherein a hose-use airflow path is formed at least in part by the accessory hose, the hose inlet, the collection chamber, and the air outlet.

21. The surface cleaning machine of claim 14, wherein the recovery tank includes an air outlet affording fluid communication between the suction source and the collection chamber, and wherein a floor-cleaning airflow path is formed at least in part by the suction nozzle, the passage, the collection chamber, and the air outlet.

22. The surface cleaning machine of claim 14, wherein the recovery tank is removably coupled to the base.

23. The surface cleaning machine of claim 22, wherein the base includes a recovery tank receptacle that removably receives the recovery tank.

24. The surface cleaning machine of claim 23, wherein the recovery tank receptacle defines a stop and the recovery tank includes a notch, the notch and the stop in detent engagement to retain the recovery tank within the recovery tank receptacle.

25. The surface cleaning machine of claim 14, wherein the passage includes an outlet that opens into the collection chamber, and wherein the valve member covers the outlet when the valve member is in the closed position.

* * * * *